US006269653B1

(12) United States Patent
Katuša

(10) Patent No.: US 6,269,653 B1
(45) Date of Patent: Aug. 7, 2001

(54) PORTABLE DEVICE FOR REFRIGERATING BEVERAGES

(76) Inventor: Nikola Katuša, Jadranska 6, 21 315 Dugi Rat (HR)

( * ) Notice: Subject to any disclaimer, the term of this patent is extended or adjusted under 35 U.S.C. 154(b) by 0 days.

(21) Appl. No.: 09/412,016

(22) Filed: Oct. 4, 1999

(30) Foreign Application Priority Data

Feb. 12, 1998 (HR) ..... 980612A

(51) Int. Cl.[7] ..... F17C 13/00
(52) U.S. Cl. ..... 62/457.9; 62/3.62; 62/238.2
(58) Field of Search ..... 62/457.9, 3.62, 62/267, 238.2

(56) References Cited

U.S. PATENT DOCUMENTS

| | | | |
|---|---|---|---|
| 2,603,071 | 7/1952 | Kalhoefer . | |
| 2,734,351 | 2/1956 | Stewart . | |
| 2,736,174 | 2/1956 | Tice . | |
| 2,991,628 | 7/1961 | Tuck . | |
| 3,012,418 | 12/1961 | Hill, 2nd . | |
| 3,109,299 | 11/1963 | Anderson . | |
| 4,006,606 | 2/1977 | Underdue . | |
| 4,274,262 | 6/1981 | Reed et al. . | |
| 4,759,190 | 7/1988 | Trachtenberg et al. . | |
| 5,042,258 * | 8/1991 | Sundhar | 62/3.2 |
| 5,181,393 * | 1/1993 | Lott | 62/264 |
| 5,782,106 * | 7/1998 | Park | 62/452 |

FOREIGN PATENT DOCUMENTS 4-201877 * 7/1992 (JP) ..... 62/457.9

OTHER PUBLICATIONS http://www.chilla.co.uk/product–vinchilla.html.

* cited by examiner

*Primary Examiner*—Michael Powell Buiz
*Assistant Examiner*—Melvin Jones
(74) *Attorney, Agent, or Firm*—Frost Brown Todd LLC

(57) ABSTRACT

A portable refrigeration device is provided that includes a containerized beverage receptacle having inner and outer walls. The portable refrigeration device includes a refrigeration unit disposed within a refrigeration unit compartment disposed beneath the containerized beverage receptacle. A coolant circulating tube circulates coolant about the periphery of the beverage receptacle. A containerized beverage support is provided within the beverage receptacle and includes support shelves to support containerized beverages such as bottles of wine, soft drinks, or the like. A containerized beverage receptacle lid, having an indentation is provided that allows the neck of a wine bottle to pass there through when the lid is placed on the beverage receptacle.

14 Claims, 4 Drawing Sheets

PORTABLE DEVICE FOR REFRIGERATING BEVERAGES

This application claims priority benefit of Republic of Croatia patent application No. P980612A (filed Dec. 2, 1998).

TECHNICAL FIELD

The present invention relates generally to portable devices designed to cool or refrigerate containerized beverages and is particularly directed to such devices having an integral refrigeration apparatus.

BACKGROUND OF THE INVENTION

It is well known that for refrigeration of beverages, especially in bars and restaurants, specifically designed vessels, such as ice buckets, are used into which a bottle or some other container of beverage is placed and surrounded with ice cubes in order to chill it to a desirable temperature for consumption. Such a vessel is customarily held on a table or in the vicinity of a table near consumers in hotel rooms, cruise ships, restaurants or the like. Obviously, if the vessel is left alone for a period of time inside a warm room or in ambient conditions, the ice gradually melts allowing the containerized beverage (a wine bottle for example) to warm to an undesirable temperature. Accordingly, it periodically becomes necessary for new ice to be added to the container.

One problem associated with the above-described prior art chilling system is that bottles or other containers, when removed from the chilling vessel, tend to be covered with moisture. This moisture may, when a customer or waiter pours a drink, dribble onto a tablecloth or onto the guests being served. This moisture also frequently causes a label, on a wine bottle for example, to become torn, loosened, or wrinkled resulting in a less pleasing presentation to a consumer.

Other prior art beverage chilling systems use beverage cooling containers adapted to receive multiple-use chilling packs which need to be frozen before usage. Such multiple-use chilling pack systems are disadvantageous in situations where it is impossible or impractical to have a steady supply of frozen chilling packs.

SUMMARY OF THE INVENTION

Accordingly, it is a primary object of the present invention to overcome the above-described limitations and disadvantages in the portable refrigeration unit prior art.

Additional objects, advantages and other novel features of the invention will be set forth in part in the description that follows and in part will become apparent to those skilled in the art upon examination of the following or may be learned with the practice of the invention as described and claimed herein.

To achieve the foregoing and other objects, and in accordance with one aspect of the present invention, an improved portable device for refrigerating containerized beverages is provided that includes an integral beverage cooling apparatus. The device of the present invention includes a receptacle adapted to receive containerized beverages (e.g. wine bottles or soft drink cans). The device further includes an integral beverage cooling apparatus, preferably disposed below the beverage receptacle. The beverage receptacle preferably includes one or more handles for ease of transport. The beverage receptacle is in communication with the cooling apparatus through a grid of ventilation apertures.

The internal surface of the beverage receptacle preferably includes a thin ribbed non-corrosive material which carries a holder for the beverage containers. Between the outer layer of the beverage receptacle and the inner ribbed layer, a plurality of pipes are provided that circulate the cooling medium. The device may be equipped with any suitable prior art cooling apparatus to circulate the cooling medium through the walls of the beverage receptacle.

Still other objects of the present invention will become apparent to those skilled in this art from the following description and drawing wherein there is described and shown a preferred embodiment of the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrates several aspects of the present invention, and together with the description and claims serves to explain the principles of the invention. In the accompanying drawings:

DETAILED DESCRIPTION OF THE PREFERRED EMBODIMENT

With reference now to the drawings, wherein like numerals indicate like elements throughout the views, an improved portable refrigeration device 10 is provided that includes a containerized beverage receptacle 12. As shown in FIGS. 1–4, the containerized beverage receptacle 12 is adapted to receive containerized beverages to be refrigerated such as soft drink cans, wine bottles, or any other suitable beverage container. Although it is preferred that the containerized beverage receptacle be of substantially circular cross section, the containerized beverage receptacle may be of substantially any shape. Preferably, the containerized beverage receptacle is comprised of an engineering thermoplastic or any other suitable material that exhibits insulating qualities. In an additional preferred embodiment, the portable refrigeration device 10 and containerized beverage receptacle 12 are comprised of metal or metal alloy. The containerized beverage receptacle 12 preferably includes one or more handles 40. (See FIG. 1). Handles 40 allow the portable refrigeration device to be manually grasped, lifted, and transported from place to place.

Figure 4:
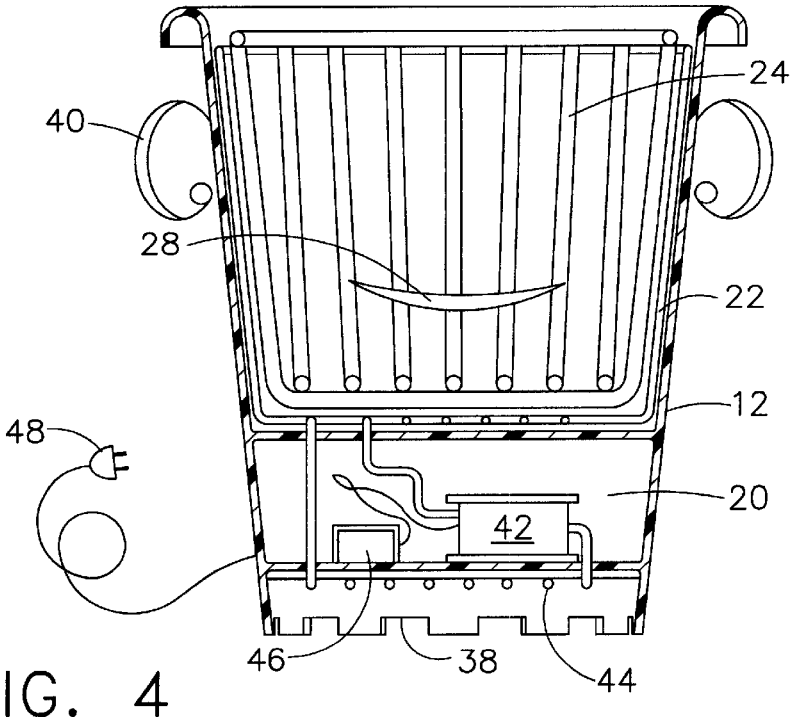
FIG. 4 is a cross-sectional view of the device of the present invention taken along line A—A of FIG. 1.
Figure 5:
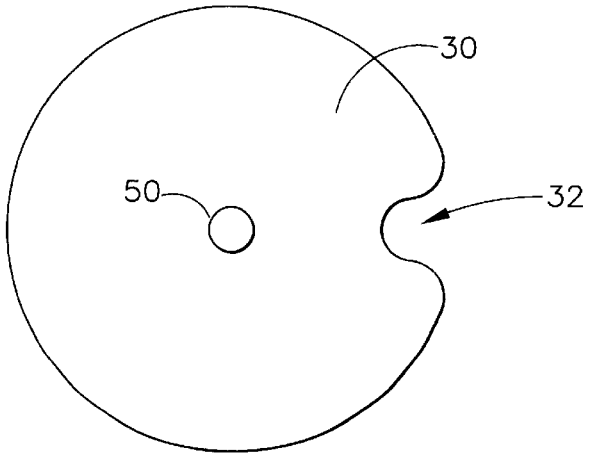
FIG. 5 is a top plan view of the lid of the device of the present invention.
Figure 6:
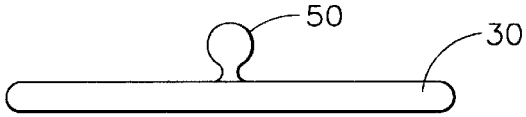
FIG. 6 is a side plan view of the lid of the device of the present invention.
Figure 7:
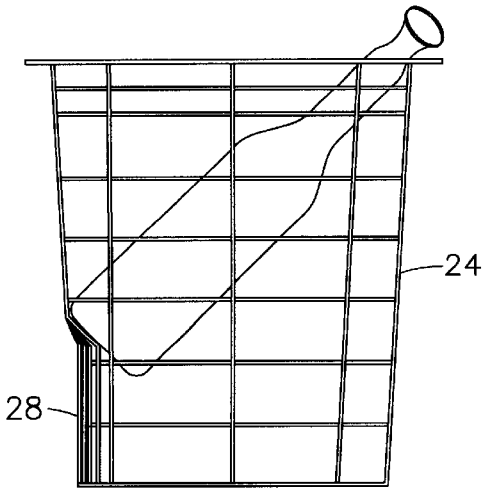
FIG. 7 is a cross-sectional view of the containerized beverage support of the present invention showing a bottle being supported by a beverage support shelf.
Figure 8:
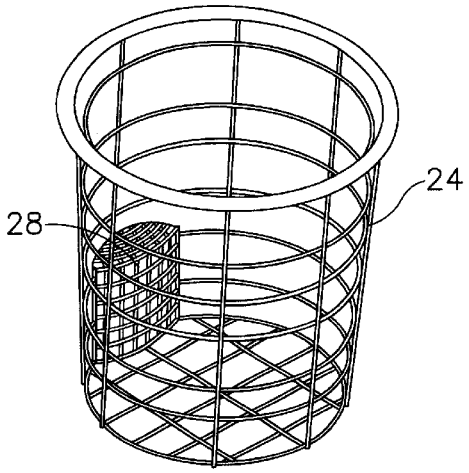
FIG. 8 is a perspective view of the containerized beverage support of the present invention.
Figure 9:
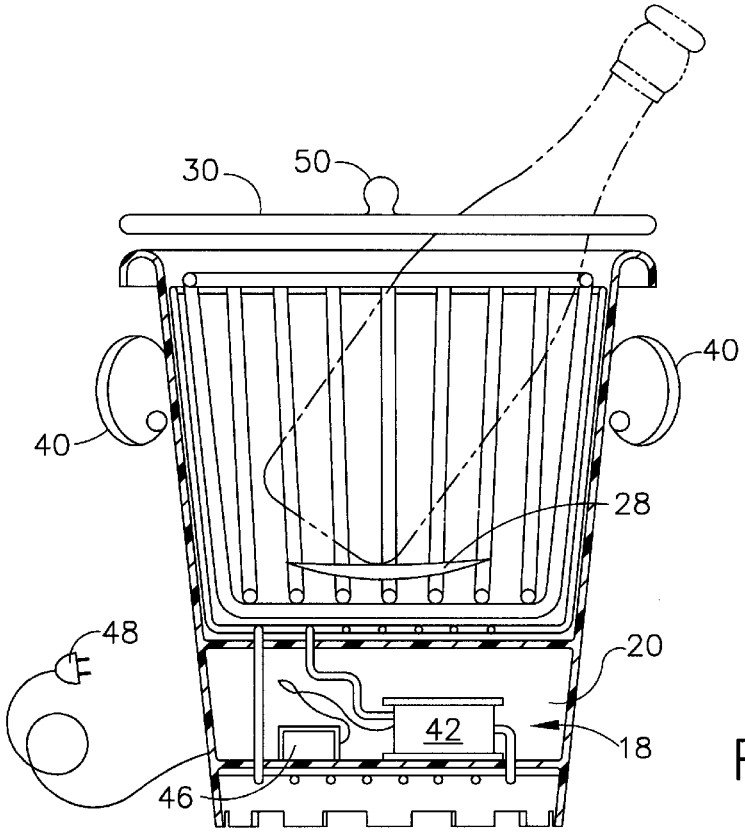
FIG. 9 is a cross-sectional view of the present invention with a bottle in place on a beverage support shelf.
Figure 10:
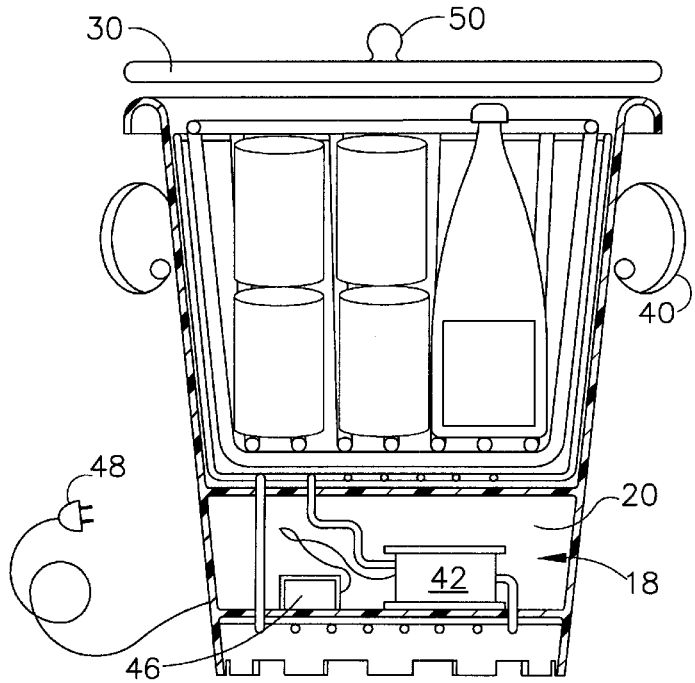
FIG. 10 is a cross-sectional view of the present invention showing canned and bottled beverages in the containerized beverage support.

As best shown in FIGS. 4–6, the portable refrigeration device 10 preferably includes a lid 30 having a lid handle 50. Lid 30 rests on an annular flange disposed on an inside wall of receptacle 12. The lid 30, as seen in FIG. 5, preferably includes an indentation 32 configured to allow the neck of a containerized beverage, such as a wine bottle, to pass through when the lid is placed on the beverage receptacle. The indentation 32 allows for taller beverages to be chilled in the portable refrigeration device 10 while simultaneously allowing for the rest of the open top of the containerized beverage receptacle 12 to be sealed by lid 30, thereby minimizing loss of cooled air from the receptacle 12.

Figure 3:
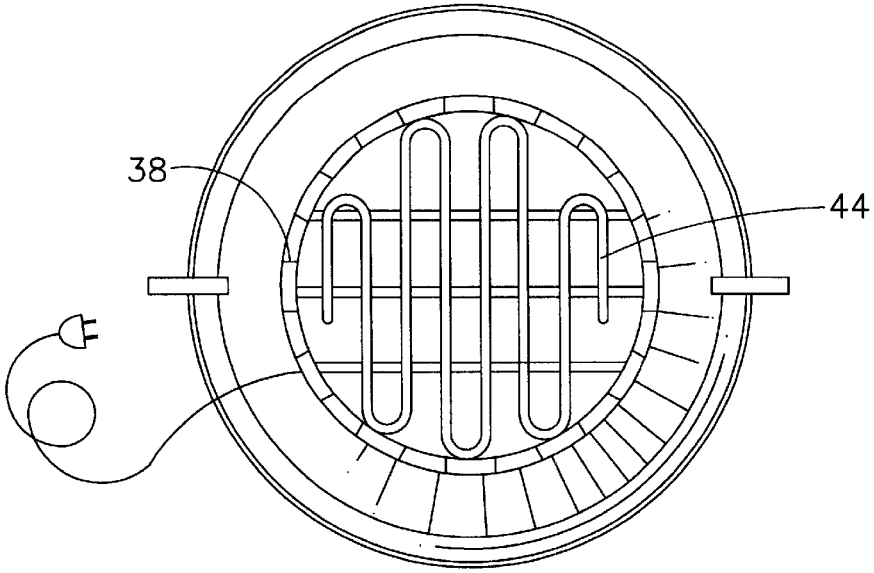
FIG. 3 is a bottom plan view of the device of the present invention.

As best shown in FIG. 4, the portable refrigeration device 10 includes a refrigeration unit 18 that includes a compressor 42, a condenser 44, and a thermoelectric motor 46 coupled to the compressor 42. The components of the refrigeration unit 18 are disposed in refrigeration unit compartment 20. Refrigeration unit compartment 20 is preferably disposed adjacently with containerized beverage receptacle 12. More preferably, the refrigeration unit compartment 20 is disposed underneath and below the containerized beverage receptacle 12. As best shown in FIGS. 3 and 4, the portable refrigeration device 10 includes a plurality of ribs disposed underneath the refrigeration unit compartment 20. As shown in FIG. 3, there is preferably an opening in the base of the refrigeration unit compartment 20. The provision of ribs 38 and the opening in the base of refrigeration unit compartment 20 allows for air to advantageously circulate into the compartment 20 and to cool the condenser 44.

The portable refrigeration unit 10 also includes a coolant circulating tube 22 which has one end in communication with a high pressure side of the refrigeration unit and a second end in communication with a low pressure side of the refrigeration unit 18. The coolant circulating tube 22 provides a continuous passageway for refrigerant. Preferably, the coolant circulating tube 22 is disposed between inner and outer walls of the containerized beverage receptacle 12. Alternatively, the coolant circulating tube 22 may be disposed on the inner walls of the containerized beverage receptacle 12. Although it is preferred that the coolant circulating tube 22 is wound about the periphery of the receptacle 12, it should be appreciated that tube 22 may be disposed in any suitable arrangement that provides adequate circulation of the refrigerant. Accordingly, refrigerant can pass from the high pressure side of the refrigeration unit 18 into the coolant circulating tube 22 and back into the low pressure side of the refrigeration unit 18.

Figure 1:
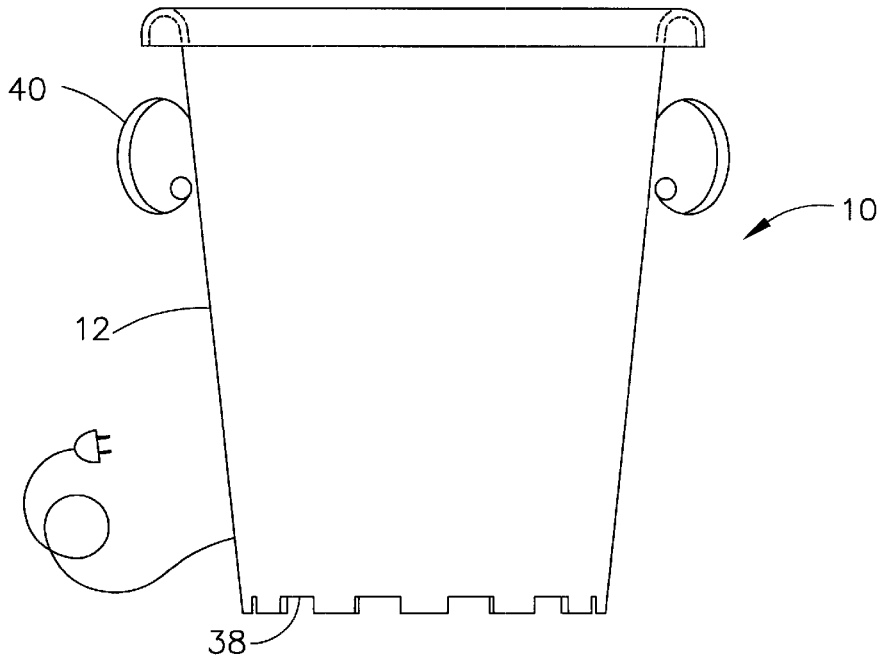
FIG. 1 is a side plan view of the portable device for refrigerating beverages of the present invention.
Figure 2:
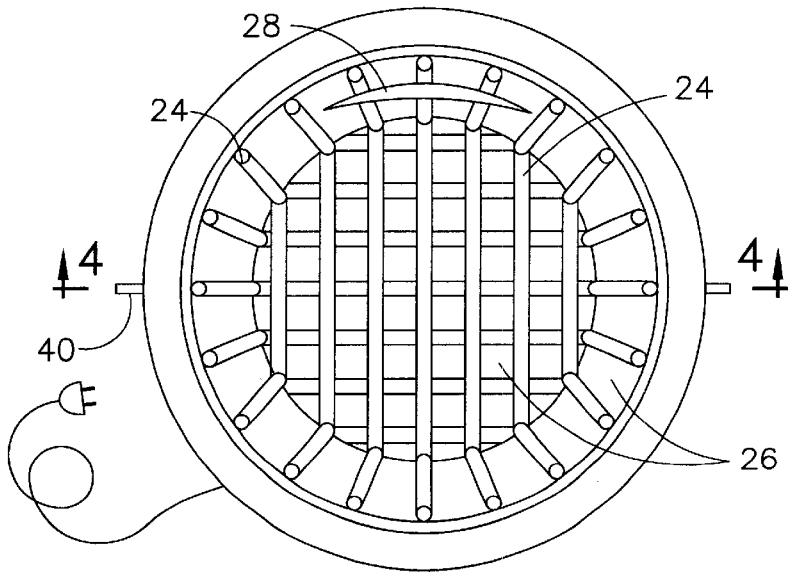
FIG. 2 is a top plan view of the device of the present invention shown with the lid removed.

The portable refrigeration device 10 also includes a containerized beverage support 24. The containerized beverage support 24 is adapted to be received within the containerized beverage receptacle 12. The beverage support 24 may include one more beverage support shelves 28 (see FIGS. 2 and 4). Support shelves 28 are adapted to support containerized beverages thereon and may be of any suitable configuration for that purpose. Preferably, shelves 28 are round and adapted to accommodate one or more wine bottles. As best shown in FIG. 2, the beverage support 24 includes a plurality of apertures 26. Apertures 26 give the beverage support 24 a substantially grid-like configuration. Preferably, the beverage support 24 includes a grid-like bottom having a similar shape to the bottom of the containerized beverage receptacle 12. Further, beverage support 24 preferably includes spaced apart bars that form the sides of the beverage support 24. The apertures 26 between the bars and grid-like bottom of the beverage support 24 allow for chilled air to advantageously circulate about the beverages being supported on shelves 28. Further, beverage support 24 also acts to protect the cooling tube 22 from inadvertent and potentially damaging contact.

The motor 46 of the refrigeration unit 18 can be connected to any suitable energy source, such as a small storage battery, an electrical system of a motor vehicle, or a standard household electrical outlet by means of an electrical cord. In an alternative embodiment, the portable refrigeration device 10 of the present invention may include a thermoresponsive control which is operatively connected to the motor by means of connecting wires. The thermoresponsive control controls the motor in response to the temperature in the beverage receptacle 12. The thermoresponsive control may be provided with an external indicator which would allow a user to receive a visual indication of the setting of the thermocontrol. The thermocontrol would permit an accurate and speedy control of the temperature within the beverage receptacle 12.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended thereto.

What is claimed is:

1. A portable refrigeration device comprising:

(a) a containerized beverage receptacle, said receptacle comprising inner and outer walls, said refrigeration device comprising a ribbed bottom configured to allow air flow underneath said unit when said unit is resting on a surface;

(b) a refrigeration unit, said refrigeration unit being disposed within a refrigeration unit compartment, said refrigeration unit compartment being adjacently disposed with said containerized beverage receptacle, said refrigeration unit further comprising a compressor, a condenser, and a thermal electric motor coupled to said compressor, said refrigeration unit compartment being disposed substantially underneath said containerized beverage receptacle;

(c) a coolant circulating tube, said tube having a first end in communication with a high pressure side of said refrigeration unit and a second end in communication with a low pressure side of said refrigeration unit, said coolant circulating tube being disposed within said containerized beverage receptacle;

(d) a containerized beverage support, said beverage support being adapted to be received within said containerized beverage receptacle, said beverage support comprising one or more beverage support shelves, said beverage support further comprising a plurality of apertures adapted to permit airflow therethrough;

(e) a containerized beverage receptacle lid, said lid including an indentation configured to allow the neck of a containerized beverage to pass therethrough when said lid is placed on said beverage receptacle; and (f) an energy source adapted to power said refrigeration unit.

2. The portable refrigeration device of claim 1 wherein said containerized beverage receptacle comprises a pair of opposed handles disposed on said outer walls of said containerized beverage receptacle.

3. The portable refrigeration device of claim 1 wherein said refrigeration unit compartment includes one or more ventilation openings adapted to permit air flow about said refrigeration unit.

4. The portable refrigeration device of claim 1 wherein said inner walls of said containerized beverage receptacle comprises a layer of non-corrosive material.

5. The portable refrigeration device of claim 4 wherein said containerized beverage receptacle and said refrigeration unit compartment are comprised of an engineering thermoplastic.

6. The portable refrigeration device of claim 1 wherein said energy source comprises a battery.

7. The portable refrigeration device of claim 1 wherein said energy source comprises a household electrical outlet and wherein said portable refrigeration device further comprises an electrical cord connected with said refrigeration unit.

8. The portable refrigeration device of claim 1 wherein said containerized beverage receptacle includes an annular flange adapted to receive said lid.

9. A portable refrigeration device comprising:

(a) a containerized beverage receptacle, said receptacle comprising inner and outer walls, said refrigeration device comprising a bottom configured to allow air flow underneath said unit when said unit is resting on a surface;

(b) a refrigeration unit, said refrigeration unit being disposed within a refrigeration unit compartment, said refrigeration unit compartment being adjacently disposed with said containerized beverage receptacle, said refrigeration unit further comprising a compressor, a condenser, and a thermal electric motor coupled to said compressor, said refrigeration unit compartment being disposed substantially underneath said containerized beverage receptacle;

(c) a coolant circulating tube, said tube having a first end in communication with a high pressure side of said refrigeration unit and a second end in communication with a low pressure side of said refrigeration unit, said coolant circulating tube being disposed within said containerized beverage receptacle;

(d) a containerized beverage support, said beverage support being adapted to be received within said containerized beverage receptacle, said beverage support comprising one or more beverage support shelves, said beverage support further comprising a plurality of apertures adapted to permit airflow therethrough;

(e) a containerized beverage receptacle lid, said lid including an indentation configured to allow the neck of a containerized beverage to pass therethrough when said lid is placed on said beverage receptacle; and (f) an energy source adapted to power said refrigeration unit.

10. The portable refrigeration device of claim 9 wherein said bottom of said refrigeration device is ribbed.

11. The portable refrigeration device of claim 9 wherein said containerized beverage receptacle comprises a pair of opposed handles disposed on said outer walls of said containerized beverage receptacle.

12. A portable refrigeration device comprising:

(a) a containerized beverage receptacle, said receptacle comprising inner and outer walls;

(b) a refrigeration unit, said refrigeration unit being disposed within a refrigeration unit compartment, said refrigeration unit compartment being adjacently disposed with said containerized beverage receptacle;

(c) a coolant circulating tube, said tube having a first end in communication with a high pressure side of said refrigeration unit and a second end in communication with a low pressure side of said refrigeration unit, said coolant circulating tube being disposed within said containerized beverage receptacle;

(d) a containerized beverage support, said beverage support being adapted to be received within said containerized beverage receptacle, said beverage support comprising one or more beverage support shelves, said beverage support further comprising a plurality of apertures adapted to permit airflow therethrough;

(e) a containerized beverage receptacle lid, said lid including an indentation configured to allow the neck of a containerized beverage to pass therethrough when said lid is placed on said beverage receptacle; and (f) an energy source adapted to power said refrigeration unit.

13. The portable refrigeration device of claim 12 wherein said bottom of said refrigeration device is ribbed.

14. The portable refrigeration device of claim 12 wherein said containerized beverage receptacle comprises a pair of opposed handles disposed on said outer walls of said containerized beverage receptacle.

* * * * *